US007964810B2

(12) United States Patent
Keist et al.

(10) Patent No.: US 7,964,810 B2
(45) Date of Patent: Jun. 21, 2011

(54) ELECTRICALLY CONDUCTING CONTACT AND METHOD FOR PRODUCTION THEREOF

(75) Inventors: Christoph Keist, Wattwil (CH); Klaus Hoffmann, Grenzach-Wyhlen (DE)

(73) Assignee: Abatek International AG (CH)

( * ) Notice: Subject to any disclaimer, the term of this patent is extended or adjusted under 35 U.S.C. 154(b) by 534 days.

(21) Appl. No.: 11/919,841

(22) PCT Filed: May 4, 2006

(86) PCT No.: PCT/CH2006/000244

§ 371 (c)(1),
(2), (4) Date: Nov. 2, 2007

(87) PCT Pub. No.: WO2006/119657

PCT Pub. Date: Nov. 16, 2006

(65) Prior Publication Data

US 2009/0068857 A1 Mar. 12, 2009

(30) Foreign Application Priority Data

May 6, 2005 (CH) ..... 808/05

(51) Int. Cl.
*H01H 3/12* (2006.01)

(52) U.S. Cl. ..... 200/264; 200/512

(58) Field of Classification Search ..... 200/341
See application file for complete search history.

(56) References Cited

U.S. PATENT DOCUMENTS

| | | | | |
|---|---|---|---|---|
| 3,617,666 | A | 11/1971 | Braue | |
| 3,932,722 | A * | 1/1976 | Obata et al. | 200/513 |
| 4,010,338 | A * | 3/1977 | Amsler | 218/126 |
| 5,047,602 | A | 9/1991 | Lipka | |
| 5,917,165 | A * | 6/1999 | Platt et al. | 200/600 |
| 2005/0042895 | A1 | 2/2005 | Liu | |

FOREIGN PATENT DOCUMENTS

| | | |
|---|---|---|
| DE | 2335907 A1 | 1/1975 |
| EP | 0938111 A2 | 8/1999 |

* cited by examiner

*Primary Examiner* — Renee S Luebke
*Assistant Examiner* — Lisa Klaus
(74) *Attorney, Agent, or Firm* — The Webb Law Firm

(57) ABSTRACT

A contact element for the intermittent contacting of conductor tracks on a circuit board, in particular, for flexible touchpads, for example for flexible input devices in the automobile industry, is made from a metal foam. The metal foam may be at least partly infiltrated by an elastomeric material which can also be the material of construction of the touchpad. The contact element has a very reliable construction which is particularly suitable for high voltage application. A method for production of the contact element, touchpads/input devices with such contact pads and the use of the contact pads is also provided.

21 Claims, 5 Drawing Sheets

ELECTRICALLY CONDUCTING CONTACT AND METHOD FOR PRODUCTION THEREOF

BACKGROUND OF THE INVENTION

1. Field of the Invention

The present invention relates to a contact element for the intermittent contacting of conductor tracks on a circuit board, in particular for flexible keypads or input devices. Furthermore, it relates to a method for producing flexible keypads or input devices and to uses of such contact elements.

2. Description of Related Art

Silicone keypads are also being used increasingly frequently in the automobile sector, such as for example for switching mirror adjusters, window openers, etc.

In resistance-coded circuits, it is decisive that a contact element that is of very low resistance and reliable is available. If contact elements that are of high resistance and unreliable are used, contact disturbances or even failures occur. It is likewise of great importance that high currents of, for example, 200 mA can be switched, in particular for the direct switching of motors.

In the case of such keypads, typically a flexible pad, for example of silicone, is arranged over a circuit board. Arranged on the circuit board are conductor tracks, which have interruptions at the locations to be actuated. Arranged on the underside of the flexible silicone pad, and bridging these interruptions, are contact elements, which are at a distance from the circuit board. These contact elements are typically referred to as contact pills. If the flexible pad is pressed down in the correct region, contacting takes place.

For such applications, today normally two different types of contact pills are used, both with serious disadvantages.

Carbon Pill:

Silicone material is made conductive with carbon or other electrically conducting particles, pressed into sheets and punched out, and then vulcanized together with the keypad in the compression mold.

A disadvantage of these pills is always that the contact resistance is dependent on the pressing pressure, i.e. if the key is pressed only quite lightly, there is a very high switching resistance, which can be misinterpreted. This is unacceptable in particular whenever different functionalities are to be coded in series over the same conductor path by way of usually different sized resistances, since a completely different functionality that happens to be arranged in the same conductor path is correspondingly triggered for example in the event of only slight actuation. Also, often contact resistances that are not really low (<1 ohm) are achieved.

Gold Pill:

A copper sheet is laminated on one side with a silicone layer and coated on the other side with metal and gold. Pills are then punched from the sheet and vulcanized together with the keypad in the compression mold.

A disadvantage of this pill is the high price of the material and the high reject rates in the process, and also the high susceptibility to contamination. As soon as a grain of dust gets in between the pill and the circuit board, the contact is isolated and fails on account of its rigid structure. A further disadvantage is that the gold pill only responds under certain pressing pressure and not directly on contact with the circuit board.

Metal Gauze:

DE 23 35 907, U.S. Pat. No. 5,047,602, EP 0 938 111 and others also describe the possibility of providing a woven or a nonwoven fiber structure of metal or carbon fibers or of conductively coated fibers as a contact region for a switch. A disadvantage of such solutions, entirely analogously to the particles in the carbon pill mentioned, is the fact that it always has to be ensured that the fibers are actually in sufficient contact in order to ensure the conductivity. Moreover, precisely this contacting is a property that rapidly deteriorates when a switch is intensively actuated, and the fibers have the tendency to break when they age.

SUMMARY OF THE INVENTION

The invention is accordingly based on the object of providing an improved contact element for the intermittent contacting of conductor tracks on a circuit board or a similar support with interrupted conductor tracks. This is to be used in particular for flexible keypads or input devices, such as for example for the automobile sector.

The solution achieving this object is obtained by the contact element comprising a metal sponge, which on the one hand has a well-defined conductivity or a well-defined ohmic resistance when the conductor tracks are bridged, as a result of the contiguous network of metal present in it. A metal sponge also inherently has a certain flexibility and elastic deformability, which can always ensure good contacting, in particular under repeated actuation and for example under actuation at an angle. The flexibility even allows dirt particles to be absorbed to a certain extent.

In particular in comparison with the use of a metal gauze or carbon fibers, the following unexpectedly functionally important advantages are obtained when a metal sponge is used as a contact element:

- The contacts on the surface of the metal foam are connected to one another in a fixed and coherent manner by means of the lattice, while in the case of the metal gauze the connection is loose. Metal foam therefore increases the contact reliability enormously, in particular in the critical cases of low contact pressing forces. If the resistance increases in cases of low contact pressing forces, use in resistance-coded circuits is only possible to a very restricted extent and entails a great risk of malfunctions.
- Carbon fibers have a higher resistance than metal foam. With carbon fibers, 2 ohms are achieved, while the metal foam achieves 0.2 ohms. Moreover, carbon fibers need a certain pressing pressure to conduct well, which in turn is a decisive disadvantage in the critical cases of low contact pressing forces.
- Metal foam can switch currents of up to 500 mA at 12 V, while metal gauze suffers from contact erosion and fails even under low currents, because of the very thin metal filaments.
- The production of contact pills from metal foam comprises a simple punching operation, while the very thin metal gauze can only be punched with difficulty because of the fibrous character; in any event, it first has to be laminated in order to prevent penetration by the insulated silicone during the molding process. The production costs of contact pills of metal foam are correspondingly lower.
- Material costs of metal foam pills are lower than metal gauze.

According to a first preferred embodiment, the metal sponge is a metal sponge that has a substantially contiguous metal-based network, in order to allow the aforementioned functionality to be reliably undertaken. In particular, the metal sponge preferably has at the same time a substantially contiguous network of cavities. However, it is also possible in principle to use so-called metal foams (also known as metallic foams), in which the cavities do not form a substantially completely contiguous network but are rather made up of pores.

The term metal sponge is to be understood hereafter as meaning a contiguous metal-based network that has cavities in the form of a substantially contiguous network.

A further preferred embodiment of such a metal sponge is distinguished by the fact that the cavities of the metal sponge are at least partially filled with an elastomeric material. This embodiment is surprisingly distinguished by outstanding functionality. The elastomeric, and consequently elastic material arranged in the cavities has the effect that the therefore at least partially filled, with preference completely filled, metal sponge as a whole is provided with permanently elastic properties. While an "empty" metal sponge or metal foam can under some circumstances also be irreversibly deformed, in particular under strong mechanical loading, if the cavities are not filled with elastic material, this is no longer possible in the case of such a filled metal sponge because of the elastic material arranged in the cavities. The metallic network is also prevented from breaking under loading, also thereby preventing a resultant impairment of the conductivity. On the other hand, however, the network of metallic material makes the conductivity reliable and constant. In this way, a contact element that can undertake its function outstandingly for long periods of time, even under intense repeated and even aggressive use, is provided in an astonishingly simple production process.

The construction is particularly simple if, according to a further preferred embodiment, the contact element in the form of a contact pill is connected to a keypad or to an element of a keypad, the keypad or the element of the keypad consisting of an elastomeric material, and this elastomeric material at least partially penetrating the cavities of the metal sponge. In turn, it is preferred in this case that the elastomeric material penetrates the cavities of the metal sponge substantially completely.

The elastomeric material may be a material selected from: silicone elastomer, vulcanized and unvulcanized liquid silicone rubber, thermoplastic elastomer or rubber. In other words, those materials that are already typically used in the area of keypads are used.

A most particularly simple construction, which is distinguished by a simple, reliable production process and low production costs, is possible if the elastomeric material arranged in the cavities is the material of the keypad and to a certain extent material of the keypad infiltrates at least partially into the contact pill. The material of the keypad then penetrates the contact pill at least partially, which on the one hand has the effect that the contact pill is firmly connected to the keypad, and on the other hand has the effect that the contact pill is provided with the lasting elastic properties discussed above.

Another preferred embodiment is characterized in that the contact element takes the form of a contact pill, the cavities of which are at least partially filled, with preference in at least one surface region, with an electrically conducting elastomeric material, with preference elastomeric material mixed with graphite or metal particles, such as for example nickel particles, with particular preference elastomeric silicone mixed with graphite or metal particles, such as for example nickel particles. An increase in the conductivity can also be achieved by the contact element taking the form of a contact pill, and the contact pill being provided on the surface facing the conductor tracks with an additional metallic coating, in particular of gold or chromium.

As far as the term contact pill is concerned, it must be specified that these pills may be circular, to a certain extent circular-cylindrical, elements, but may also be of an oval, hexagonal, square, rectangular or any other basic form. The contact pill is typically a circular contact element.

The material of the metal sponge is preferably a metal selected from the group: nickel, chromium, gold, aluminum, copper or alloys or mixtures formed from these. Foams or sponges that consist of different metals in a stratified form are also possible.

Such sponges may be produced for example in a depositing process (CVD, chemical vapor deposition), a plastic foam being coated with metal and the plastic subsequently removed, so that a contiguous metal sponge with contiguous cavities is obtained. Metal foams or metal sponges with an average pore size in the range of 100-1000 μm with preference in the range of 550-700 μm, with particular preference in the range of 600-650 μm, are preferred. With preference, the contact element takes the form of a contact pill with a thickness in the range of 0.5-3 mm, with preference in the range of 0.5-0.9 mm. The metal sponge advantageously has a density in the range of 200-800 $g/m^2$, with particular preference in the range of 300-500 $g/m^2$, this being with reference to a material thickness of 1.6 mm.

Furthermore, the present invention relates to a method for producing a keypad or an element of a keypad (for example a silicone dome) with a contact element, such as that described further above. The method is characterized in that such a contact element is placed into a compression mold, an injection mold or a transfer mold, with preference on depressions provided for the contacts, an elastomer mixture is subsequently placed, fed and/or injected in, and, with the mold closed, the pressure and temperature in the mold are set in such a way that the elastomer becomes low in viscosity and infiltrates at least partially into the metal sponge. The pressure and temperature in the mold are preferably set in such a way that the elastomer infiltrates substantially completely into the metal sponge of the contact element in the form of a contact pill.

The contact element may be presented in the form of a contact pill which is produced from a metal sponge sheet in a punching process or a cutting process, in which with preference a partial compaction of the metal sponge is brought about. Before or after the punching process, the contact pill and/or the metal sponge sheet may be at least partially filled or coated by a knife-applying, printing or spraying process with an electrically conducting or nonconducting elastomeric material, or be provided with an additional metallic coating, in particular of gold or chromium. If the metal sponge sheet is already filled with an elastomeric material, such a contact element can also subsequently be adhesively attached at the corresponding locations of a keypad or otherwise connected to it (for example from below onto a silicone dome).

Furthermore, the present invention relates to the use of a contact element such as that described above, and preferably produced by a method such as that specified above, as a contact pill for keypads or in elements or component parts for keypads or input devices, such as for example keyboards, or input devices in particular from the automobile sector such as window openers, mirror adjusters, and/or for the direct switching of motors. The latter is possible since the contact elements according to the invention can reliably switch comparatively high currents.

Further possible uses comprise that such a contact element is formed as a conductor track embedded in the elastomer, such as for example silicone, using for this a metal foam or a metal sponge, in particular with an integrated contact area, for example to realize a key function in a flexible silicone armband or generally in a silicone keypad. Quite generally, a metal foam or a metal sponge may be embedded as a flexible contact path in elastomer, such as for example in silicone. For instance as a flexible touchpad or for example for security applications in which an alarm is set off when there is a disconnection, for example as the result of an interruption of a circuit formed by it. Also possible is use as EMC shielding, with the metal foam or metal sponge being embedded in an elastomer, such as for example in a silicone, over a large surface area, i.e. the full surface area or in the form of a net with a mesh width adapted in particular to the frequencies to be shielded.

DESCRIPTION OF THE DRAWINGS

The invention is to be explained in more detail below on the basis of exemplary embodiments in connection with the drawings, in which.

DETAILED DESCRIPTION OF THE PRESENT INVENTION

Figure 1:
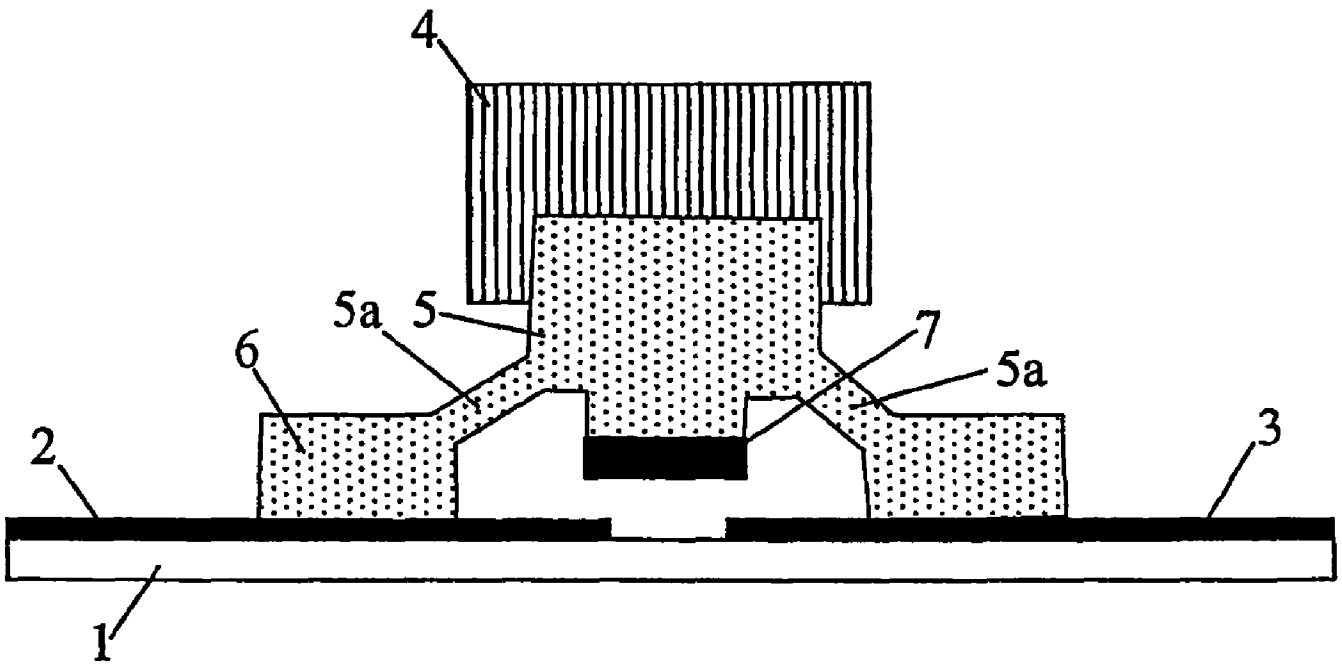
FIG. 1 shows a schematic representation of a switching region of a keypad (silicone dome) according to the prior art.
Figure 2:
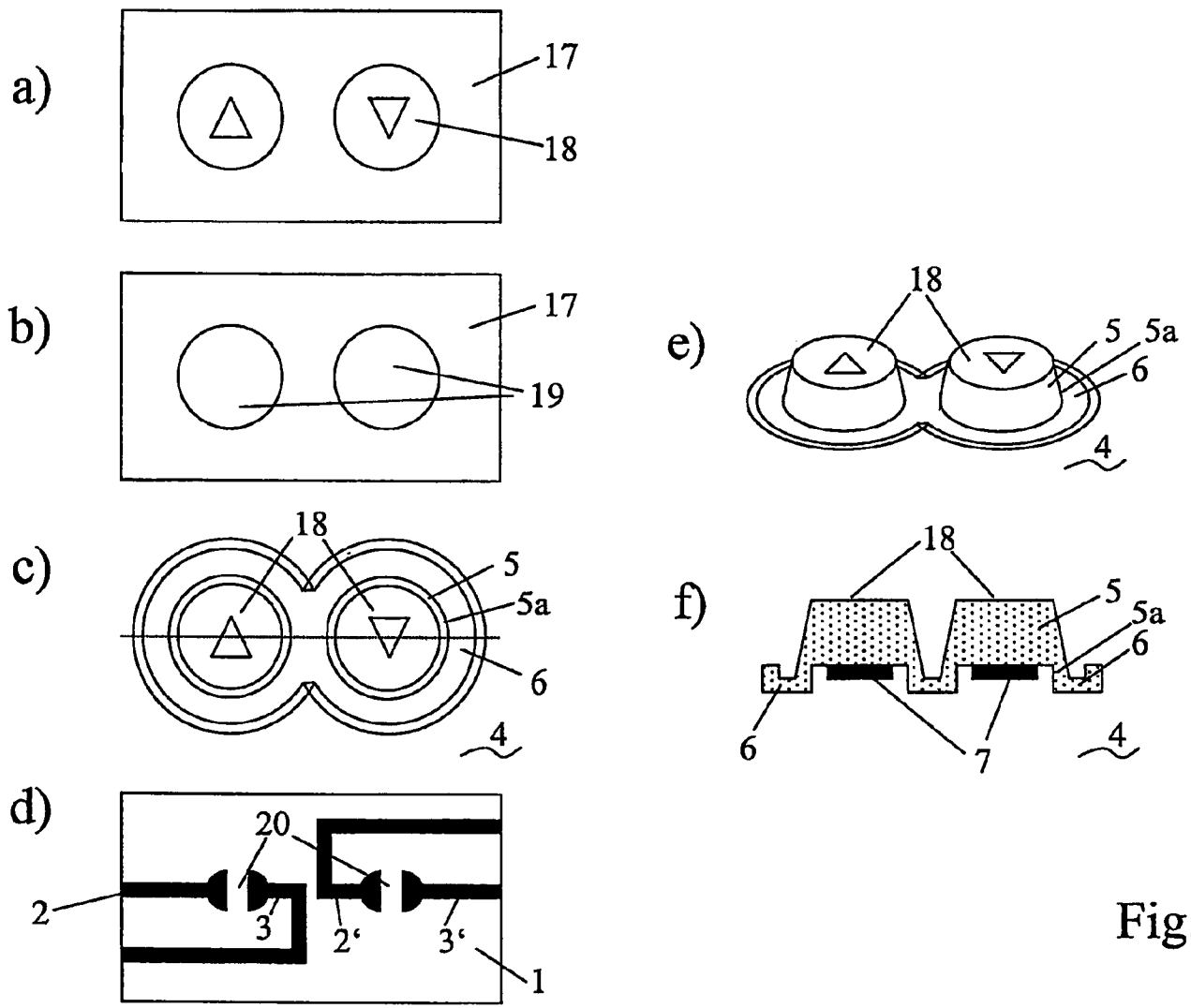
FIG. 2 shows a schematic representation of a keypad element for a motor controller, wherein a) illustrates a view from above of the entire component, b) illustrates a view from above of the diaphragm, c) illustrates a view from above of the keypad, d) illustrates a view from above of the circuit board, e) illustrates a perspective view of the keypad and f) illustrates a section through a keypad along the dotted line in FIG. 2*c*)

The present invention is to be understood in particular in connection with keypads, such as those first to be explained generally on the basis of FIGS. 1 and 2.

FIG. 1 shows a section through the switching region of a keypad. Conductor tracks 2, 3 are provided on a circuit board 1. These conductor tracks are interrupted at a defined location, and it is intended that contacting, that is to say bridging of the two conductor tracks 2, 3, is to be made possible at this location by manual input (pressing where a keyboard is concerned) from above. For this purpose, on the circuit board there is a keypad, which in the specific case comprises a plastic cap 4, underneath which flexible elements, for example of silicone, are respectively arranged in the switching regions. These flexible elements comprise a silicone dome 5, which is connected in the upward direction to the plastic cap 4. Laterally alongside the interruption of the conductor tracks, this dome 5 is supported on the circuit board by means of a membrane 5*a* with the keypad base 6. The dome 5, the membrane 5*a* and the base 6 are produced in one piece from a flexible material. Such an element is also referred to as a silicone key. Fastened on the underside of the dome 5 is a contact pill 7.

If the plastic cap 4 is then pressed downward from above, for example with a finger, after reaching a threshold force there occurs a buckling of the membrane 5*a*, and the contact pill 7 is pressed down onto the circuit board 1 or onto the two conductor tracks 2, 3 respectively fed in from the left and the right. Since the contact pill is a conducting element, for example a carbon pill or gold pill, the conductors 2 and 3 are thereby connected to one another, and switching occurs. After letting go, the silicone dome quickly returns again into its original position, represented in FIG. 1, on account of the elasticity of the material of the membrane 5*a*, which has the effect that the connection is interrupted again, since the contact pill is removed upward out of the contact region.

This situation is represented rather more specifically in FIG. 2, where for example the switching of a window opener or a mirror, that is to say an application in the automobile sector, is represented in detail. FIG. 2*a*) shows a view of such a switching element, which comprises a diaphragm 17, which has circular clearances, as can be seen in FIG. 2*b*). Two keys 18 reach through these clearances from below. It is possible here that a plastic cap 4 is adhesively attached or placed over the keys.

The keypad in this case comprises two actual switching elements, as can be seen in FIG. 2*c*), a view from above, and in 2*e*), a perspective view, and in 2*f*), a section along the dotted line in FIG. 2*c*). Arranged underneath this keypad 4 is the circuit board 1, which is represented in FIG. 2*d*) and arranged on which are two separate conductor paths, which respectively have contacting regions 20 underneath the keys 18, that is to say the conductors are interrupted in these regions 20 and are to be bridged there by the contact pills 7 of the keypad whenever the keypad is correspondingly actuated. Here, too, the keypad is produced from a flexible elastic material, such as for example silicone rubber, and comprises a dome 5, a membrane 5*a* and the base 6 in one piece, an independent cavity in which the contact pills 7 are fastened from below being formed between the base and the dome.

The aim of the present invention is to find to a certain extent a solution that combines the advantages of the two aforementioned technologies of the carbon pill and the gold pill and at the same time eliminates their disadvantages. In other words, the softness of the carbon pill (dirt is entrapped, low in price) with the electrical properties of the gold pill (very low contact resistance, independent of actuating force).

Figure 3:
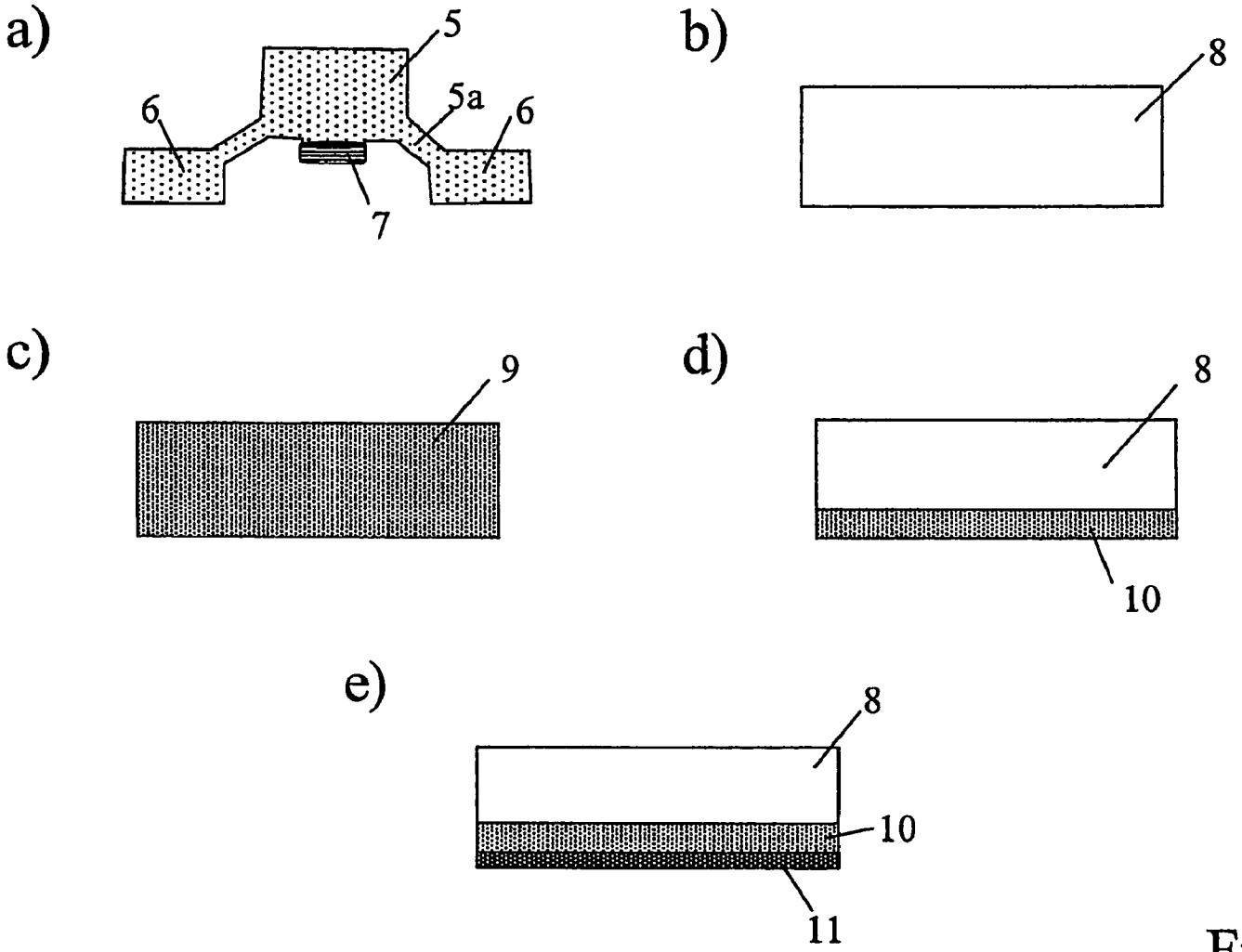
FIG. 3 shows a) an element of a keypad with metal foam as the contact pill; b) shows metal foam without a filling; c) shows metal foam completely filled with elastomer; d) shows metal foam filled with elastomer in the surface region; e) shows metal foam according to d) with an additional metallic coating.

This is achieved by using a metal sponge as the material for the contact pill 7, with preference a nickel metal sponge with a porosity of, for example, 100 PPI (pores per inch) and a density of, for example, 400 gr/m$^2$ in the case of a thickness of typically 1.6 mm. This is schematically represented in FIG. 3*a*).

Contact pills are punched from the metal foam or sponge. When doing this, if need be the foam or sponge may be compressed somewhat. The method for producing the contact pills is explained further below in connection with FIG. 4.

The sponge pills are placed into the compression mold on the depressions provided for the contacts, an elastomer mixture is subsequently placed or injected or fed in, and the mold is closed. The pressure (typically 150 kg/cm$^2$) and the temperature in the mold (typically 170° C.) cause the elastomer to become low in viscosity and infiltrate at least partially into the metal sponge. At the same time, the metal sponge is compressed by the pressure in the compression mold and forms quite a homogeneous surface area, partly interspersed with elastomer, on the lower side. This surface area then serves as a contact element, the sponge conducting as a "network" not only on the surface but over the entire pill.

Such metal sponge pills have electrical properties approaching those of the gold pills, without being susceptible to dirt, and can also be produced at low cost.

In the simplest embodiment, the pill of metal sponge is a pill that is punched or cut out from metal sponge and is otherwise not modified any further. The situation is represented in FIG. 3*b*). This electrically conducting metal sponge or foam is vulcanized together with the insulating silicone in the mold or is applied to the keypad in some other way, for example by adhesive bonding, clamping, etc.

In another embodiment, before it is fastened to the keypad or is integrated into the keypad, the metal sponge pill is already at least partially filled with an elastomeric material, which may be formed such that it is nonconducting or additionally electrically conducting. The metal foam is fully or partially filled with an electrically conducting or nonconducting material. This may be, for example, silicone mixed with graphite or metallic powder. Such a metal sponge pill completely filled with material is schematically represented in FIG. 3*c*). The pills are then produced from these sheets.

In a further embodiment, for better conductivity, the metal sponge pill is additionally coated at least on the side facing the contacts, that is to say facing the conductor tracks. In other words, the metal sponge is coated with electrically conductive material on one or both sides. The coating may be carried out for example by a knife-applying or spraying process. Such a coating 10 is schematically represented in FIG. 3*d*).

An additional embodiment comprises that the metal sponge pill is provided with a surface finish. For this purpose, the metal sponge may be additionally coated on one or both sides or all over with gold or some other high-grade layer, in order to increase the conductivity and reduce the contact erosion. The metal foam pill is, for example, gold-plated by means of vapor-depositing or electrocoating. This may be carried out in the case of all variants on one or both sides. Alternatively, the punched pills may be coated in a drum. Such an embodiment in combination with a coating 10 is schematically represented in FIG. 3*e*).

The following are among the general advantages of this construction that can be listed:

- low cost
- no modification of existing molds necessary
- contact resistance independent of contact pressure
- insensitive to dirt and dust
- low contact resistance
- high switching currents possible, which for example allows the direct control of motors
- direct contact-making on contact with the circuit board.

Specific Details:

Metal Sponge:

In principle, there are various types of porous metallic supports:

- So-called cellular metal: the space is divided into discrete cells. The boundaries of the cells are formed from solid metal, and the inner spaces are hollow. Ideally, the individual cells are all separate from one another.
- So-called porous metal: the metal contains a multiplicity of pores, that is to say closed curved gas spaces with a smooth surface.
- So-called metal(lic) foam: foams are a special form of porous metals. Such a foam is created from a liquid foam in which gas bubbles are present in the liquid in a finely dispersed form.
- So-called metal sponge: the space is filled by a continuous, linked network of metal in coexistence with a likewise contiguous network of cavities. Such metal sponge products are produced for example by the CVD (chemical vapor deposition) process, where a plastic foam is coated with metal and, in a second step, the plastic is then removed, so that only a metal sponge remains.

Coming into consideration for the present invention are conductive metal foams and metal sponges, the latter being preferred.

Such metal sponges consist for example of nickel, nickel coated for example with chromium or gold, aluminum, copper, etc. Various pores sizes may be used, typically 400 μm.

Specifically suited is, for example, the product: Incofoam Ni Purity; in a thickness in the range of 1.7 mm-2.3 mm, with 1.7 mm being preferred (can be rolled flatter still), with a density (respectively referred to a material thickness of 1.6 mm) of 400-800 g/m$^2$, with preference of about 400 g/m$^2$, a cell size of 550-700 μm, with 610 μm being preferred. Obtainable from Inco Special Products.

Figure 4:
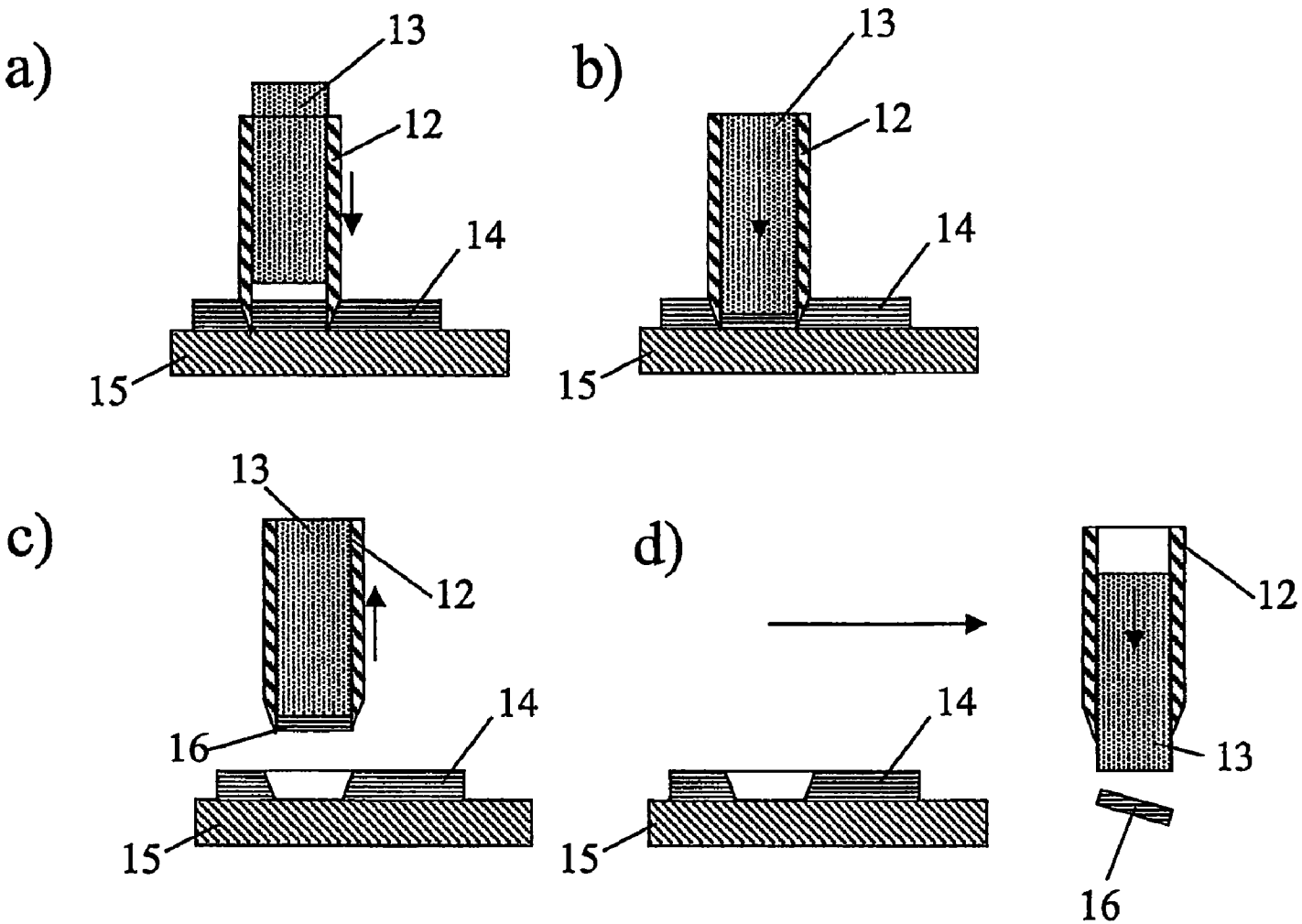
FIG. 4 shows in a)-d) individual steps of a possible method for producing a contact pill.

A possible method for producing such contact pills 7 from a metal sponge sheet 14 is represented in FIG. 4. As can be seen in FIG. 4*a*), a punching tool 12, for example of a circular form, with a concentrically arranged ram or pusher 13 is used. The punching tool 12 has at its tip a taper that is conically formed on the outer side and leads to the actual cutting edge.

The metal sponge sheet 14 is placed on a soft underlying surface 15, and the punching tool 12 is introduced in a punching manner into the metal sponge sheet 14 with the ram 13 retracted.

In a next step (compare FIG. 4*b*), the punched piece 16 (the pill) detached in this way is compressed by the ram 13 to the extent required for the planned application, typically to 0.7 mm.

Subsequently, as represented in FIG. 4*c*, the punching tool 12, 13 is retracted, the punched piece 16 remaining attached in the punching tool. To assist this, a magnetic device or a device based on negative pressure (suction) may be provided in the ram.

Subsequently, the punching tool 12, 13 is displaced and, as represented in FIG. 4*d*), the punched piece 16, or the contact pill, is removed from the punching tool 12 by the pusher 13 and, for example, caught in a container, or else placed straightaway into a mold.

Figure 5:
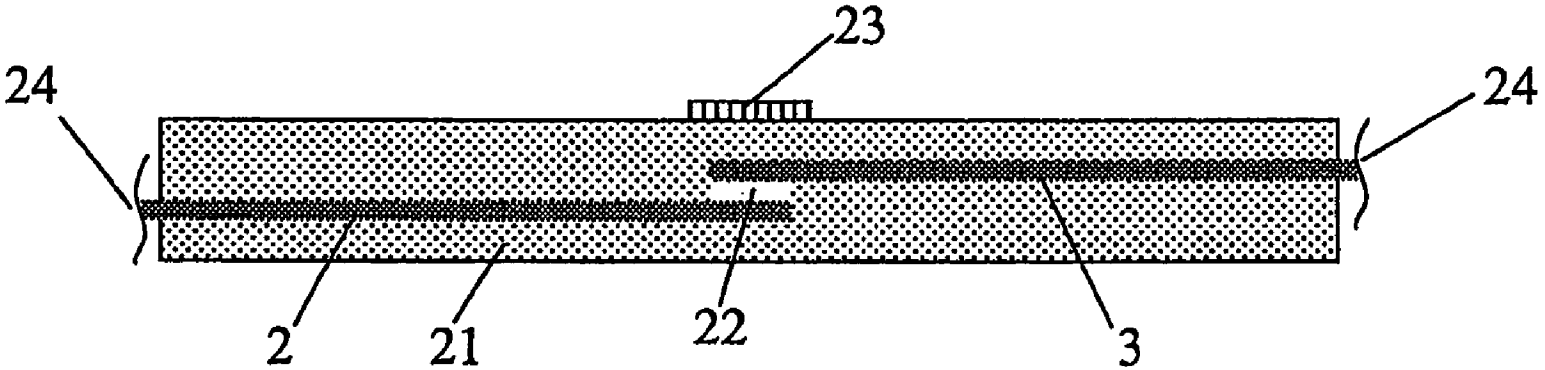
FIG. 5 shows a further exemplary embodiment in which an integrated flexible keypad is represented.

In FIG. 5, a further possible way of using such a metal sponge or a metal foam is also represented. In a flexible pad 21 of an elastomer, in the specific case of silicone, two conductors 2 and 3 of metal foam or metal sponge are embedded and penetrated by the elastomer or silicone in such a way that in one region they are led one over the other. Between the two conductors there is a cavity 22 in this region. The conductors are connected at the locations 24 to corresponding electronic components or to circuits, and, if a pressure is then exerted from above (or equally from below) on this pad 21 in a schematically represented key region 23, the two conductors 2, 3 establish contact on account of the flexibility of the pad 21 and consequently provide a key function. Such a pad may in turn be produced by the conductors being placed into a mold, for example as unfilled metal foams or metal sponges, and the elastomer subsequently being fed in to form the structure according to FIG. 5.

Coating:

Electrically conductive or nonconductive elastomers may be applied in processes such as for example knife coating, spraying, screen printing, pad printing, etc.

Liquid silicone 3631 from Dow Corning may be used as the base material for the coating or as a flexible filling material.

Nickel-coated carbon particles from Inco Special Products may be used for example as conducting particles.

Xyshield type XY800 Nickel Plated Graphite from Laird Technologies may be used as a paste for a coating (base material+ready-mixed particles).

HTV silicones, possibly with color pigments; for example type B6670, 30-80 Shore A, with 70 Shore A being preferred, from Dow Corning may be used as flexible filling material.

Surface Finish:

Materials such as gold, chromium, etc. may be applied in processes such as for example sputtering, vapor-depositing, electroplating, etc.

Keypad/Elastomer:

Typically, HTV silicone elastomer for keymats is used; the present invention can also be realized, however, with liquid silicone rubber (LSR), thermoplastic elastomers (TPE) or rubber of any kind.

Processing:

The metal sponge can be punched into pills and placed directly into the compression mold.

The metal sponge can be formed with elastomer into sheets, from which the contact pills are then punched or cut (also laser techniques). These are then in turn vulcanized together with the silicone in the mold.

To improve the conductivity, pills may also be produced with metal sponge and conducting elastomer (elastomer+conducting particles).

Instead of compression molds, the pills may also be placed into injection molds, transfer molds or other molds.

Attachment of the pill to the keypad:

Positive engagement: silicone flows into the structure of the metal sponge

Chemical: filling material/coating enters into chemical bond with silicone keypad Adhesive bonding: pills applied to ready-made keypad by adhesive bonding Contact pill:

Round, rectangular, of any form

Thickness: metal sponge thickness of starting material or metal sponge or foam additionally compressed in the punching process or cutting process.

The following applications of such a contact element are possible for example:

Keymats in general

Contact pills for window openers, mirror adjusters, etc.

Direct switching of motors

As a replacement for currently used low-resistance pills and gold pills

As flexible conductor tracks with integrated contact element directly embedded in the silicone.

Generally as a flexible contact path of metal foam or sponge that is embedded in the elastomer, i.e. for example in a silicone, in the form of a track or the like. So for example for security applications, for example as a flexible contact path embedded in the silicone that can set off an alarm when there is a disconnection (interruption of the circuit).

As EMC shielding if the metal foam is embedded in the silicone over a large surface area, whether in the form of a net or over the full surface area.

The invention claimed is:

1. A flexible keypad with a contact element in a form of a contact pill for intermittent contacting of conductor tracks on a circuit board, wherein the contact element comprises a metal sponge or a metal foam, wherein cavities of the metal sponge or the metal foam are substantially completely filled with an elastomeric material, and wherein the contact element is connected to the keypad or to an element of the keypad, the keypad or the element of the keypad comprising the elastomeric material that substantially completely penetrates the cavities of the metal sponge or the metal foam.

2. The flexible keypad as claimed in claim 1, wherein the contact element is a metal sponge that has a contiguous metal-based network and at the same time a substantially contiguous network of cavities.

3. The flexible keypad as claimed in claim 1, wherein the elastomeric material is a material selected from: silicone elastomer, vulcanized and unvulcanized liquid silicone rubber, thermoplastic elastomer or rubber.

4. The flexible keypad as claimed in claim 1, wherein the cavities are filled with an electrically conducting elastomeric material.

5. The flexible keypad as claimed in claim 1, wherein the contact pill is provided on a surface facing the conductor tracks with an additional metallic coating.

6. The flexible keypad as claimed in claim 1, wherein the material of the metal sponge or the metal foam is a metal selected from the group: nickel, chromium, gold, aluminum, copper or alloys formed from these.

7. The flexible keypad as claimed in claim 1, wherein the metal sponge or the metal foam has an average pore size in a range of 100-1000 μm.

8. The flexible keypad as claimed in claim 1, wherein the contact pill has a thickness in a range of 0.5-3 mm.

9. The flexible keypad as claimed in claim 1, wherein the contact element comprises a metal sponge with a density in a range of 200-800 $g/m^2$, this being with reference to a material thickness of 1.6 mm.

10. A method for producing a keypad or an element of a keypad according to claim 1, wherein the contact element is placed into a compression mold, an injection mold or a transfer mold on depressions provided for the contacts, an elastomer mixture is subsequently fed or placed in, and, with the mold closed, the pressure and temperature in the mold are set in such a way that the elastomer becomes low in viscosity and infiltrates at least partially into the metal sponge or the metal foam.

11. The method as claimed in claim 10, wherein the contact element is presented in the form of a contact pill which is produced from a metal sponge sheet or a metal foam sheet in a punching process, in which a partial compaction of the metal sponge or the metal foam is brought about.

12. The method as claimed in claim 11, wherein, before or after the punching process, the contact pill and/or the metal sponge sheet or the metal foam sheet is at least partially filled or coated by a knife-applying, printing or spraying process with an electrically conducting or nonconducting elastomeric material, or is provided with an additional metallic coating.

13. The flexible keypad as claimed in claim 1, wherein the elastomeric material is mixed with graphite or metal particles.

14. The flexible keypad as claimed in claim 13, wherein the particles are nickel particles.

15. The flexible keypad as claimed in claim 1, wherein the elastomeric material is silicone that is mixed with graphite or nickel particles.

16. The flexible keypad as claimed in claim 1, wherein the metal sponge or the metal foam has an average pore size in a range of 600-650 μm.

17. The flexible keypad as claimed in claim 1, wherein the contact element takes the form of a contact pill with a thickness in a range of 0.5-0.9 mm.

18. The flexible keypad as claimed in claim 1, wherein the contact element comprises a metal sponge with a density in a range of 300-500 $g/m^2$, this being with reference to a material thickness of 1.6 mm.

19. An automobile window opener comprising a flexible keypad as claimed in claim 1.

20. An automobile mirror adjuster, comprising a flexible keypad as claimed in claim 1.

21. A key function in a flexible silicone armband, comprising a flexible keypad as claimed in claim 1.

* * * * *